US008973203B2

(12) United States Patent
Saito

(10) Patent No.: US 8,973,203 B2
(45) Date of Patent: Mar. 10, 2015

(54) TOOTHBRUSH

(76) Inventor: Mikio Saito, Yokohama (JP)

( * ) Notice: Subject to any disclaimer, the term of this patent is extended or adjusted under 35 U.S.C. 154(b) by 0 days.

(21) Appl. No.: 13/820,430

(22) PCT Filed: Sep. 1, 2011

(86) PCT No.: PCT/JP2011/070535

§ 371 (c)(1),
(2), (4) Date: May 13, 2013

(87) PCT Pub. No.: WO2012/029992

PCT Pub. Date: Mar. 8, 2012

(65) Prior Publication Data

US 2013/0219644 A1 Aug. 29, 2013

(30) Foreign Application Priority Data

Sep. 2, 2010 (JP) ..... 2010-197083

(51) Int. Cl.
*A46B 7/04* (2006.01)
*A46B 9/04* (2006.01)

(52) U.S. Cl.
CPC .... *A46B 9/04* (2013.01); *A46B 7/04* (2013.01)
USPC ..... 15/167.1; 15/176.5

(58) Field of Classification Search
USPC ..... 15/167.1, 176.4, 176.5, 176.6; D4/104, D4/121
See application file for complete search history.

(56) References Cited

U.S. PATENT DOCUMENTS 562,760 A * 6/1896 Collins ..... 401/289
1,567,507 A * 12/1925 Howard ..... 15/176.1
1,908,510 A * 5/1933 Dodson ..... 15/176.4
4,890,349 A * 1/1990 Nitzsche ..... 15/167.1
5,224,234 A * 7/1993 Arsenault et al. ..... 15/167.1
5,555,590 A * 9/1996 Blum et al. ..... 15/167.1
5,864,915 A * 2/1999 Ra ..... 15/167.1
6,237,183 B1 * 5/2001 Fischer ..... 15/167.1
6,616,364 B2 * 9/2003 Katz et al. ..... 401/6
7,111,352 B2 * 9/2006 Yu ..... 15/176.5

FOREIGN PATENT DOCUMENTS

JP 1981-158919 U1 11/1981
JP 2002-000353 A1 1/2002

OTHER PUBLICATIONS

World Intellectual Property Office, International Search Report for PCT/JP2011/070535, Apr. 6, 2012, 1 page.

* cited by examiner

*Primary Examiner* — Randall Chin
(74) *Attorney, Agent, or Firm* — KORUS Patent, LLC; Seong Il Jeong

(57) ABSTRACT

Conventional toothbrushes must be destroyed and incinerated as refuse after use, resulting in a waste of resources and generating carbon dioxide. A toothbrush is provided with: a toothbrush body having a head formed in an oval-ring shape, the head having a female part or male part being aligned with the toothbrush body and disposed at a connection region connecting to the toothbrush body; and a replaceable bristle part having a male or female part being releasably coupled to the male part or female part of the head. Thus, after an appropriate period of use, the replaceable bristle part can be easily exchanged. The coupling of the female part or male part prevents the fore-end of the toothbrush from shaking laterally during tooth brushing. The toothbrush provides a toothbrush body for repeated reuse, and contributes significantly to the reduction of carbon dioxide by a reduction in refuse.

1 Claim, 18 Drawing Sheets

TOOTHBRUSH

TECHNICAL FIELD

The invention is directed to a toothbrush having male and/or female parts on an installation head at a fore-end of the toothbrush, on the lateral surfaces of a replaceable bristle part and on the toothbrush body.

BACKGROUND OF THE INVENTION

In some conventional toothbrushes, the whole fore-end of the toothbrush which constitutes ⅓ of the full length of the toothbrush can be exchanged. In addition, toothbrushes other than those mentioned above are usually discarded as a trash after use. These discarded toothbrushes generate collection costs and carbon dioxide when transport and incineration are performed.

DISCLOSURE OF THE INVENTION

Technical Problem

Discarding an entire toothbrush after use was the only method for conventional toothbrushes.

In addition, a conventional installation head at the fore-end of the toothbrush, as the head is formed thin and oval, can become separated during use, and can damage the mouth by splitting and/or breaking since the head is shaking from side to side.

This invention solves the problems of the compositions of conventional toothbrushes. The purposes of this invention are to permit repeated use of a toothbrush body for a long period and to reduce the consumption of resources and carbon dioxide production by forming curved or "<" shaped male and female parts at lateral surfaces of both an exchangeable bristle part and the head of the fore-end of tooth brush body, thereby making it possible to assemble and detach the bristle part with ease and freely and to exchange the bristle part with ease.

Means for Solving the Problem

This section explains the toothbrush invention in order to solve the challenges described above.

A toothbrush 1, 2, 3 according to the present invention is characterized by a toothbrush body 4, 5, 6 having a fore-end; a head 7, 8, 9 having a circular female part 12, 13, 14 or male part 15, 16, 17 and being located at the fore-end of the toothbrush body; and a replaceable bristle part 11 having bristles 19 installed at a board 10 with a circular female part 12, 13, 14 or male part 15, 16, 17, the circular female part or male part of the board 10 being attached to the circular male part or female part of the head 7, 8, 9 by mutual elastic deformation, the female part 14 or male part 17 of the head 7, 8, 9 and the female part 14 or male part 17 of the board 10 being aligned with the toothbrush body 4, 5, 6.

Because the installation head at the fore-end of the toothbrush body as described above has a thin and oval shape in front of the rod shaped toothbrush body, it separates during tooth brushing, shakes laterally, cracks, fractures and may damage the mouth. As such, it is desirable that the plastic materials used in the toothbrush body are soft and do not have cracking or fracturing characteristics such as those of elastic polypropylene.

In FIG. 70, however, as both the inner lateral surfaces of the head 32 for the bristle part 33 at the fore-end of the toothbrush body 31 of the conventional toothbrush 30 and the lateral surfaces of the bristle part 33 are curved or "<" shaped, the fore-end head portion of the toothbrush body for bristle part 33 shakes laterally when the toothbrush 30 is used as described above.

The present toothbrush invention is characterized in that shaking is prevented because of the male part 17 or female part 14 of the board 10 having the toothbrush body 4, 5, 6 direction and the female part 14 or male part 17 of the head 7, 8, 9 having the toothbrush body 4, 5, 6 direction.

In addition, although not drawn, the shape of the male and female parts are preferably curved and/or in a "<" shape. But if it's possible to be assembled and detached and prevents detaching while brushing teeth, the shape is not confined to a specific form.

As described above, the oval shapes of the head 7, 8, 9 of the toothbrush 1, 2, 3 and the board 10 are preferable, but not confined.

In addition, though it is desirable for the shape of the upper surface of a bristle part, when assembled in the head to be parallel (same surface) or in a curved shape relative to the upper surface, the shape is not confined to this specific form so long as it does not cause scars in the mouth.

In addition, although it is desirable for the male and female shapes on bristle part and toothbrush body to be capable of assembly and fit snugly and symmetrically, it is not confined to this embodiment.

In addition, when the bristle part is assembled in the head, the stopper for preventing drop out is located around the bottom of bristle part.

In addition, though it is desirable for the shape of outer stem surface of the stopper to have the same shape as the external lateral surface around the bottom of the head, but is not confined to this embodiment.

Effect of Invention

There is no need to destroy a whole toothbrush after using it. By only exchanging a bristle head, it is possible to reuse the body of a toothbrush continuously for a long period.

Reuse of the toothbrush 1, 2, 3 and the toothbrush body 4 are desirable, but not so confined.

As a result, it is possible to reduce the amount of raw material consumed and, as an indirect effect, it becomes possible to reduce carbon dioxide emissions that occur during raw material transport or product manufacturing processes, etc.

In addition, for trash reduction, it becomes possible to reduce transportation or incineration maintenance, etc. which are related to conventional disposal.

In addition, as an effect of reducing trash, incineration expenses for incineration processing may be reduced, and a large reduction in carbon dioxide emissions will be possible at the same time.

In addition, this toothbrush can contribute to reducing carbon dioxide emissions and saving of raw materials by simply exchanging the bristle part and reusing the toothbrush body rather than discarding the whole toothbrush in every 2-3 months.

In addition, except for hotel and/or electric toothbrush uses, the total consumption amount of toothbrush is statistically 300 to 400 million pieces a year. Additionally, about 6 thousand tons of plastics and packing materials are consumed. If a toothbrush body is used for 2-3 years, carbon dioxide emission may be reduced during any incineration process and there will be large amounts of raw material reduction.

In addition, materials used for exchangeable bristle parts are extremely small, the unit production cost becomes cheap, and thus, providing cheap toothbrushes becomes possible.

In addition even though there is now a high level of eco-awareness about global warming according to TV or newspaper surveys, it is hard for people to know specifically what methods there are to participate in the environmental protection movement in their lives even if they are eager to. However, in the case of toothbrushes used by most people in their lives, even if it is small, this toothbrush with exchangeable bristle part makes people have a sense that they are involved in the environmental protection movement.

However, in case of using a toothbrush—which includes an assembly of the bristle part to the head on the fore-end of the toothbrush body, as described in FIG. 70, so the lateral surfaces 36, 37 of head 32 for the bristle part 33 at the fore-end of the toothbrush body 31 of the toothbrush 30 are curved and/or "<" shaped female-male parts 34, 35, the fore-end part of the toothbrush which has bristle part 33 shakes laterally during tooth brushing.

As a way to solve the undesirable mechanism mentioned above, the present invention is characterized in that shaking is prevented between the male part 17 or female part 14 of board 10 having toothbrush 1, 2, 3 direction and the female part 14 or male part 17 of the head 7, 8, 9 having toothbrush 1, 2, 3 direction.

THE BEST FORM FOR IMPLEMENTATION OF INVENTION

As described below, a first embodiment of the invention is explained by FIGS. 1 to 6.

Figure 1:
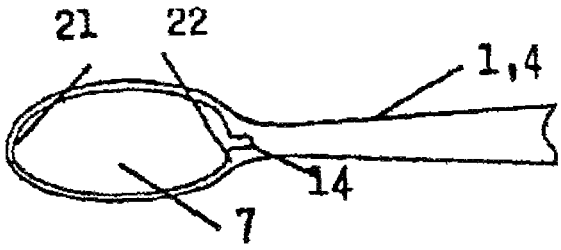
FIG. 1 is a plane figure of a toothbrush body fore-end.

FIG. 1 is a plane figure of a toothbrush body 4 of toothbrush 1 which has an installation head 7 at a fore-end part. Fore-end inner lateral surfaces 21, 22 of toothbrush body 4 are connected to the head 7 which has reciprocal curvatures for installing the bristle part 11 in FIG. 3 which has curved lateral male parts 15, 16, 17. Both sides of head 7 and the bristle part 11 have female and male parts 14, 17 to prevent the fore-end of the toothbrush from shaking while brushing with the toothbrush 1.

Figure 2:
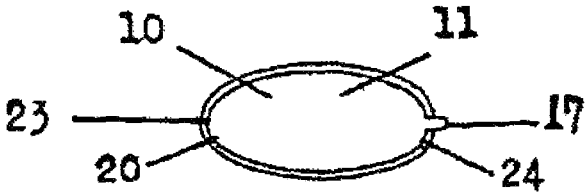
FIG. 2 is a plane figure of a bristle part.

FIG. 2 is a plane figure of bristle part 11 with board 10 which is attached to the head 7.

Elements 23 and 24 are both left and right lateral surfaces. Element 17 is a male part of bristle part 11 for preventing shaking when connected to the female part 14 of FIG. 1.

Element 20 is the stopper to prevent dropping out when assembled to the head 7.

Figure 3:
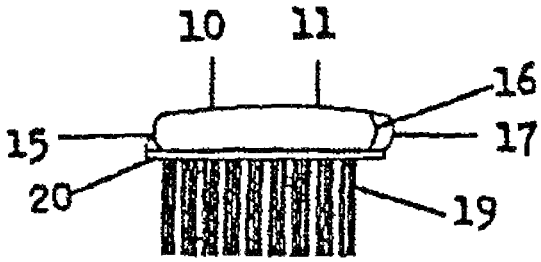
FIG. 3 is a lateral view of a bristle part.

In FIG. 3, Element 20 is the stopper as a dropping prevention mechanism when the bristle part 11 is assembled to the head 7 around the bottom of the board 10. Elements 15, 16, 17 of both lateral fore-end are convex male parts. Especially, Element 17 is the male part to prevent the fore-end of the bristle part from lateral shaking. Element 19 is bristle enrooted. This is a lateral view of male parts 15, 16, 17 with the shaking prevention curvatures on the bristle part 11.

Figure 4:
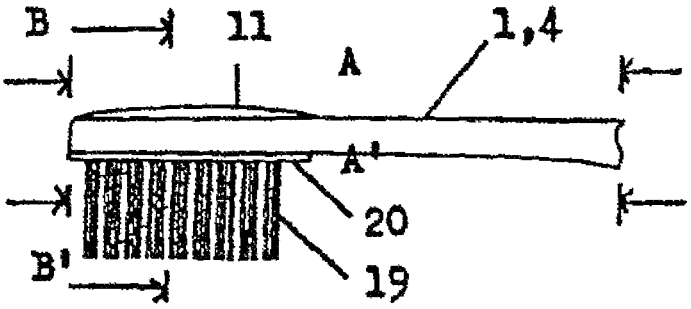
FIG. 4 is a lateral view of a toothbrush with FIG. 3 being installed in FIG. 1.

In FIG. 4, Element 1 is toothbrush, and Element 4 is toothbrush body. This is a lateral view of a fore-end of the toothbrush 1 which represents both bristle part 11 of FIG. 3 and head 7 at the fore-end of the toothbrush body 4 for bristle part 11. Element 19 is bristles of a toothbrush. Element 20 is the stopper as described above.

Figure 5:
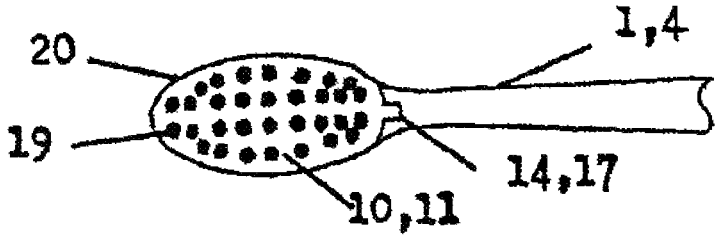
FIG. 5 is a basal view of FIG. 4.

FIG. 5 is a basal view of FIG. 4. Element 10 is a board, Element 1 is a toothbrush, and Element 4 is a toothbrush body. Element 20 is the stopper described above, Element 19 is rooted brushes, Element 14 represents female part 14 in board and male part 17 in toothbrush body 4 as a shaking prevention device when bristle part 11 is assembled to toothbrush body 4.

Figure 6:
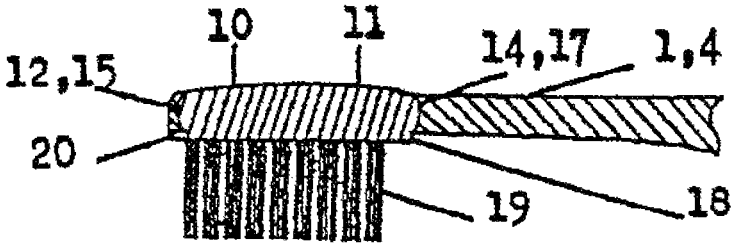
FIG. 6 is a A-A' line cross-sectional view of FIG. 4.

FIG. 6 is a A-A' line cross-sectional view of FIG. 4. Element 1 is a toothbrush, and Element 4 is a toothbrush body. Element 10 is a head, Element 11 is a bristle part, Element 19 is bristles and Element 20 is a stopper. Element 12, 14 are female parts which have a concave inside 21, 22 of the toothbrush body 4. Element 14, 17 are male parts which have a convex lateral 23, 24 to bristle part 11.

This implementation example is toothbrush 1 as stated above, and the stopper 20 at bristle part 11 is designed to protrude from the bottom of the head 7 when the bristle part 11 is assembled to the head 7 of the toothbrush body 4.

As described below, a second embodiment of the invention is shown in FIG. 7 to FIG. 12.

Figure 7:
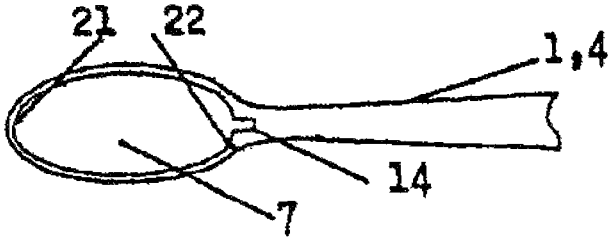
FIG. 7 is a plane figure of a toothbrush body fore-end.

FIG. 7 is a plane figure of toothbrush body 4 of toothbrush 1 which has installation head 7 at the fore-end part. Fore-end inner lateral surfaces 21, 22 of toothbrush body 4 are head 7 which have reciprocal curvatures to admit the bristle part 11 of FIG. 3 which has curved lateral male parts 15, 16, 17. Both sides of head 7 and the bristle part 11 have female and male parts 14, 17 to prevent the fore-end of the toothbrush from shaking while brushing with the toothbrush 1.

Figure 8:
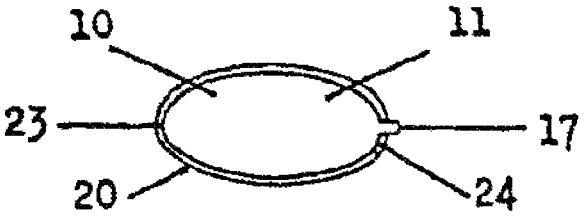
FIG. 8 is a plane figure of a bristle part.

FIG. 8 is a plane figure of bristle part 11 with board 10 which is attached to the head 7. Elements 23, 24 are both left and right lateral surfaces. Element 17 is a male part of bristle part 11 for preventing shaking when attached to female part 14 of FIG. 1.

Element 20 is the stopper to prevent dropping when assembled to the head 7.

Figure 9:
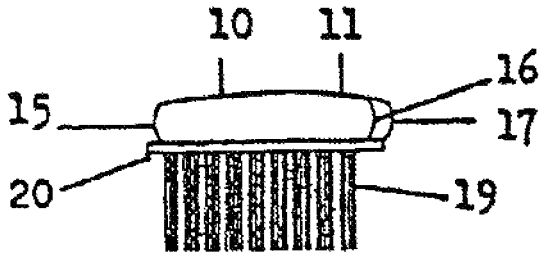
FIG. 9 is a lateral view of a bristle part.

In FIG. 9, Element 20 is the stopper as a dropping prevention mechanism when the bristle part 11 is assembled to the head 7 around the bottom of the board 10. Elements 15, 16, 17 of both lateral fore-ends are convex male parts. Especially, Element 17 is the male part to prevent the fore-end of the bristle part from lateral shaking Element 19 is enrooted bristles. This is a lateral view of male parts 15, 16, 17 with the shaking prevention curvatures on the bristle part 11.

Figure 10:
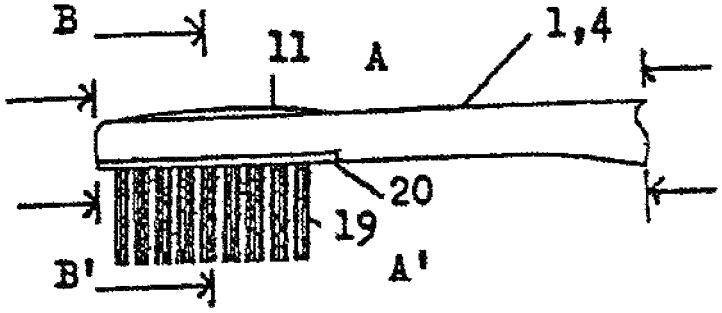
FIG. 10 is a lateral view of a toothbrush with FIG. 9 being installed in FIG. 7.

In FIG. 10, Element 1 is a toothbrush, and Element 4 is a toothbrush body. This is lateral view of fore-end of the toothbrush 1 which represents both bristle part 11 of FIG. 9 and head 7 at the fore-end of the toothbrush body 4 for bristle part 11. Element 19 is bristles. Element 20 is the stopper as described above.

Figure 11:
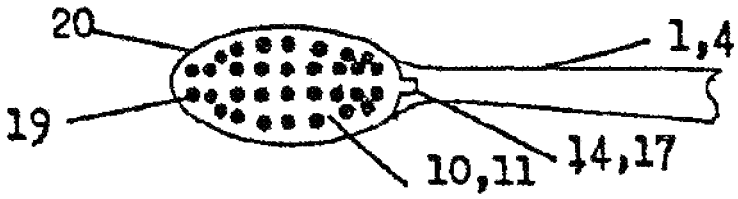
FIG. 11 is a basal view of FIG. 10.

FIG. 11 is a basal view of FIG. 10. Element 10 is a board, Element 1 is a toothbrush, and Element 4 is a toothbrush body. Element 20 is the aforementioned stopper, Element 19 is rooted brushes, and Element 14 represents female part 14 in the board and male part 17 in the toothbrush body 4 as a shaking prevention device when bristle part 11 is assembled to toothbrush body 4.

Figure 12:
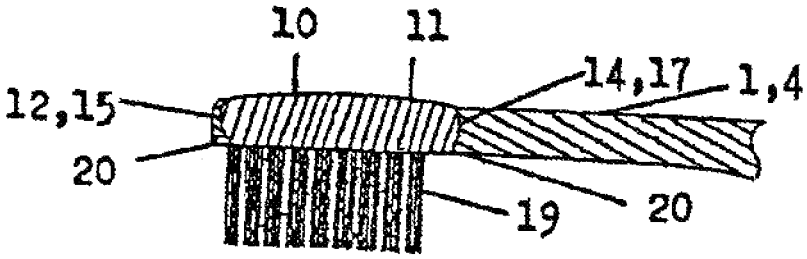
FIG. 12 is a A-A' line cross-sectional view of FIG. 10.

FIG. 12 is a A-A' line cross-sectional view of FIG. 10. Element 1 is a toothbrush, and Element 4 is a toothbrush body. Element 10 is a head, Element 11 is a bristle part, Element 19 is bristles and Element 20 is a stopper. Elements 12, 14 are female parts which have concave inside 21, 22 of the toothbrush body 4. Element 14, 17 are male parts which have convex lateral surfaces 23, 24 to bristle part 11.

This implementation example is constituted toothbrush 1 described above. It is formed to be in the same plane (even level) between the head 7 base and the stopper 20 of the bristle part 11 when bristle part 11 is attached to the head 7 of the toothbrush body 4.

A third embodiment of the invention is explained by FIGS. 13 to 18 as follows.

Figure 13:
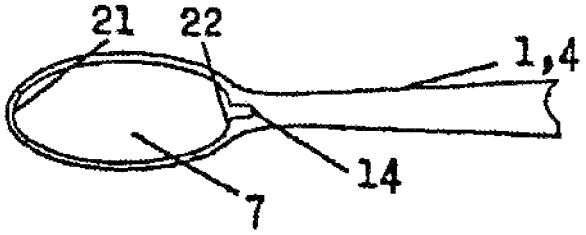
FIG. 13 is a plane figure of a toothbrush body fore-end.

FIG. 13 is a plane figure of toothbrush body 4 of toothbrush 1 which has installation head 7 at the fore-end part. Fore-end inner lateral surfaces 21, 22 of toothbrush body 4 are head 7 which has reciprocal curvatures to admit the bristle part 11 in FIG. 3 which has curved lateral male parts 15, 16, 17. Both sides of head 7 and the bristle part 11 have female and male parts 14, 17 to prevent the fore-end of the toothbrush from shaking while brushing with the toothbrush 1.

Figure 14:
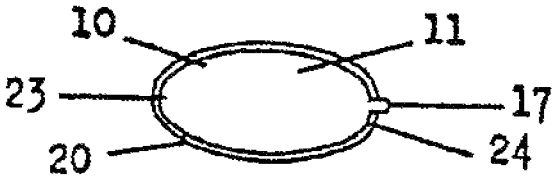
FIG. 14 is a plane figure of a bristle part.

FIG. 14 is a plane figure of bristle part 11 with board 10 which is attached to the head 7. Elements 23, 24 are both left and right lateral surfaces. Element 17 is male part of bristle part 11 for preventing shaking when attached to female part 14 of FIG. 1.

Element 20 is the stopper to prevent dropping when assembled to the head 7.

Figure 15:
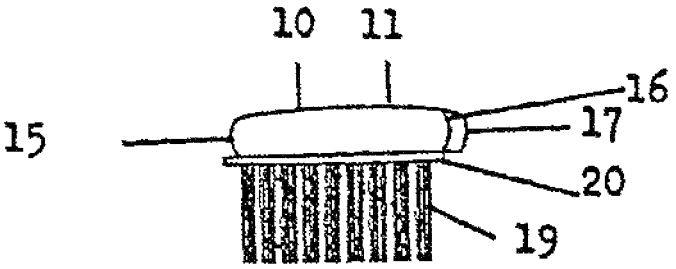
FIG. 15 is a lateral view of a bristle part.

In FIG. 15, Element 20 is the stopper to prevent dropping when the bristle part 11 is attached to the head 7 around the bottom of the board 10. Elements 15, 16, 17 of both lateral fore-ends are convex male parts. Especially, Element 17 is the male part to prevent the fore-end of the bristle part from shaking laterally. Element 19 is rooted bristles. This is a lateral view of male parts 15, 16, 17 with the shaking prevention curvatures on the bristle part 11.

Figure 16:
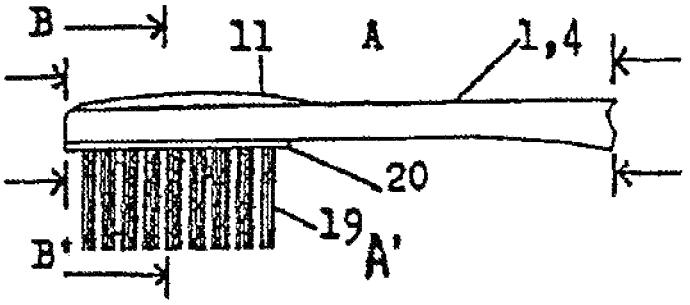
FIG. 16 is a lateral view of a toothbrush with FIG. 15 being installed in FIG. 13.

In FIG. 16, Element 1 is a toothbrush, and Element 4 is a toothbrush body. This is lateral view of the fore-end of the toothbrush 1 which represents both bristle part 11 of FIG. 15 and head 7 at the fore-end of the toothbrush body 4 for bristle part 11. Element 20 is a stopper, Element 19 is bristles.

Figure 17:
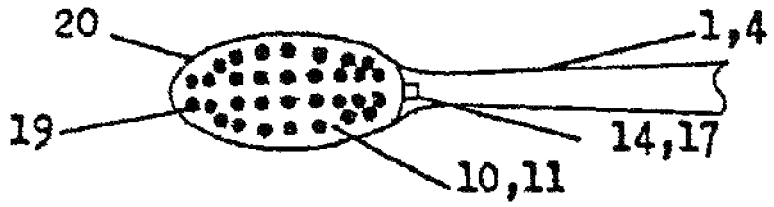
FIG. 17 is a basal view of FIG. 16.

FIG. 17 is a basal view of FIG. 16. Element 10 is a board, Element 1 is a toothbrush, and Element 4 is a toothbrush body. Element 20 is the aforementioned stopper, Element 19 is rooted brushes, and Element 14 represents female part 14 in the board and male part 17 in toothbrush body 4 as a shaking prevention device when bristle part 11 is attached to toothbrush body 4.

Figure 18:
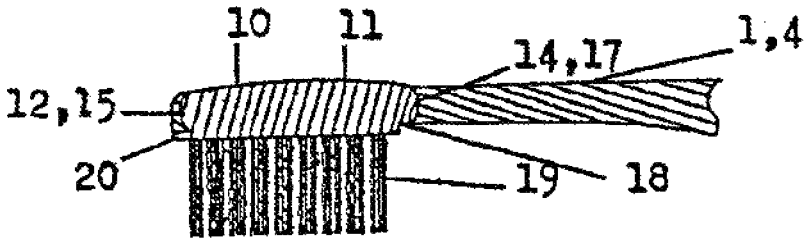
FIG. 18 is a A-A' line cross-sectional view of FIG. 16.

FIG. 18 is a A-A' line cross-sectional view of FIG. 16. Element 1 is a toothbrush, and Element 4 is a toothbrush body. Element 10 is a head, Element 11 is a bristle part, Element 19 is bristles and Element 20 is a stopper. Elements 12, 14 are female parts which have concave inside 21, 22 of the toothbrush body 4. Element 14, 17 are male parts which have convex lateral surfaces 23, 24 to bristle part 11.

This implementation example is the toothbrush 1 as described above, it is formed to be in the same level between the bottom of the head 7 and the bottom of the male part 16, 17 of the bristle part 11, when the bristle part 11 is assembled to the head 7 of the toothbrush body 4.

As described below, a fourth embodiment of the invention is explained by FIGS. 19 to 24.

Figure 19:
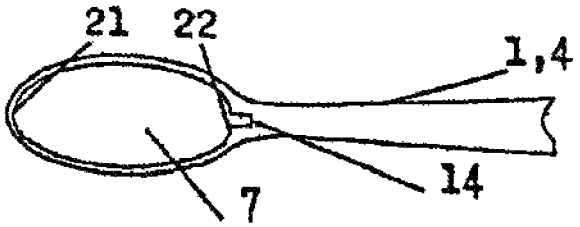
FIG. 19 is a plane figure of a toothbrush body fore-end.

FIG. 19 is a plane figure of toothbrush body 4 of a toothbrush 1 which has an installation head 7 at the fore-end part. Fore-end inner lateral surfaces 21, 22 of toothbrush body 4 are head 7 which is "<" shaped to admit the bristle part 11 in FIG. 3 which has "<" shaped both right and left lateral male parts 15, 16, 17. Both sides of head 7 and the bristle part 11 have female and male parts 14, 17 to prevent the fore-end of the toothbrush from shaking during brushing with the toothbrush 1.

Figure 20:
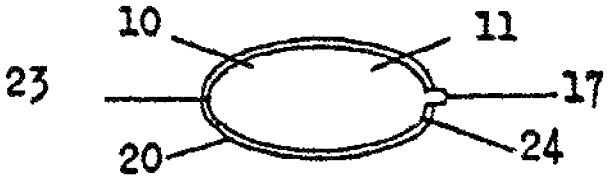
FIG. 20 is a plane figure of a bristle part.

FIG. 20 is a plane figure of bristle part 11 with board 10 which is attached to the head 7. Elements 23, 24 are both left and right lateral surfaces. Element 17 is male part of bristle part 11 for preventing shaking when attached to female part 14 of FIG. 1.

Element 20 is the stopper for preventing dropping when attached to the head 7.

Figure 21:
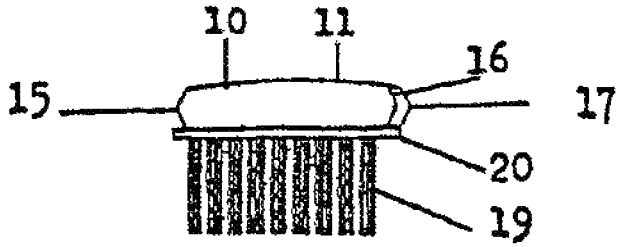
FIG. 21 is a lateral view of a bristle part.

In FIG. 21, Element 20 is the stopper for preventing dropping when the bristle part 11 is attached to the head 7 around the bottom of the board 10. Elements 15, 16, 17 of both lateral fore-end are "<" shaped male parts. Especially, Element 17 is the male part to prevent the fore-end of the bristle part from shaking laterally. Element 19 is rooted bristles. This is a lateral view of male parts 15, 16, 17 with the shaking prevention "<" shape on the bristle part 11.

Figure 22:
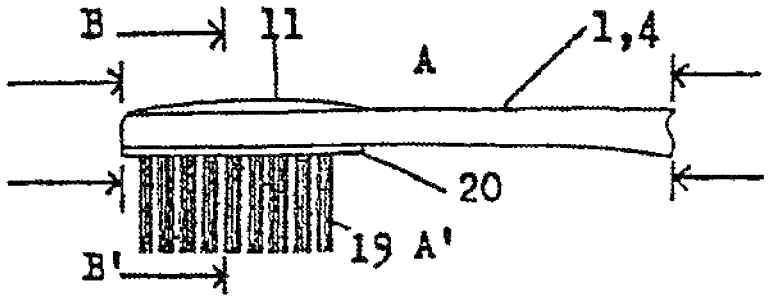
FIG. 22 is a lateral view of a toothbrush with FIG. 21 being installed in FIG. 19.

In FIG. 22, Element 1 is a toothbrush, and Element 4 is a toothbrush body. This is lateral view of fore-end of the toothbrush 1 which represents both bristle part 11 of FIG. 21 and head 7 at the fore-end of the toothbrush body 4 for bristle part 11. Element 19 is bristles. Element 20 is the stopper as described above.

Figure 23:
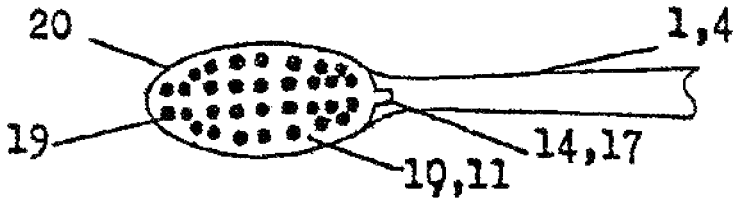
FIG. 23 is a basal view of FIG. 22.

FIG. 23 is a basal view of FIG. 22. Element 10 is boards, Element 1 is a toothbrush, and Element 4 is a toothbrush body. Element 20 is the aforementioned stopper, Element 19 is rooted brushes, and Element 14 represents female part 14 in the board and male part 17 in the toothbrush body 4 as a shaking prevention device when bristle part 11 is attached to toothbrush body 4.

Figure 24:
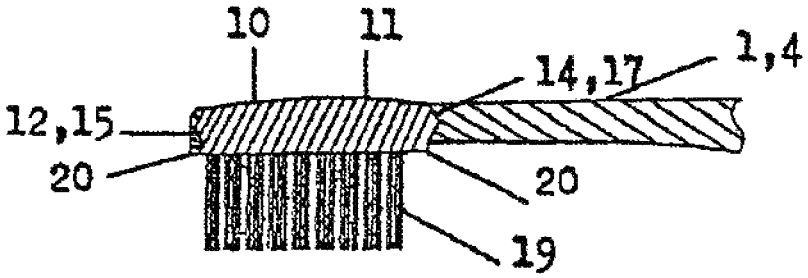
FIG. 24 is a A-A' line cross-sectional view of FIG. 22.

FIG. 24 is a A-A' line cross-sectional view of FIG. 22. Element 1 is a toothbrush, and Element 4 is a toothbrush body. Element 10 is a board, Element 11 is a bristle part, Element 19 is bristles and Element 20 is a stopper. Elements 12, 14 are female parts which have "<" shaped inside 21, 22 of the toothbrush body 4. Elements 14, 17 are male parts which have "<" shaped lateral surfaces 23, 24 to bristle part 11.

This implementation example is toothbrush 1 as stated above, and the stopper 20 at bristle part 11 is designed to protrude from the bottom of the head 7 when the bristle part 11 is attached to the head 7 of the toothbrush body 4.

From below, a fifth embodiment of the invention is shown in FIGS. 25 to 30.

Figure 25:
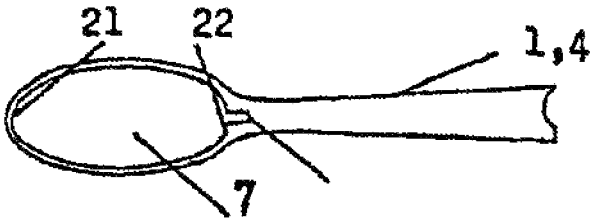
FIG. 25 is a plane figure of a toothbrush body fore-end.

FIG. 25 is a plane figure of toothbrush body 4 of toothbrush 1 which has installation head 7 at the fore-end part. Fore-end inner lateral surfaces 21, 22 of toothbrush body 4 are head 7 which is "<" shaped to admit the bristle part 11 in FIG. 3 which has "<" shaped both right and left lateral male parts 15, 16, 17. Both sides of head 7 and the bristle part 11 have female and male parts 14, 17 to prevent the fore-end of the toothbrush from shaking during brushing with the toothbrush 1.

Figure 26:
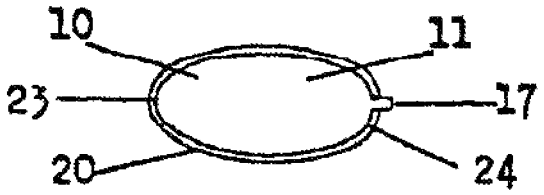
FIG. 26 is a plane figure of a bristle part.

FIG. 26 is a plane figure of bristle part 11 with board 10 which is attached to the head 7. Elements 23, 24 are both left and right lateral surfaces. Element 17 is male part of bristle part 11 for shaking prevention when assembled in female part 14 of FIG. 1.

Element 20 is the stopper for preventing dropping when attached to the head 7.

Figure 27:
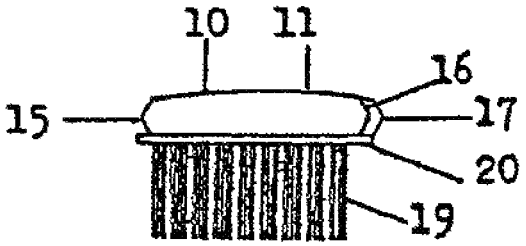
FIG. 27 is a lateral view of a bristle part.

In FIG. 27, Element 20 is the stopper for preventing dropping when the bristle part 11 is attached to the head 7 around the bottom of the board 10. Elements 15, 16, 17 of both lateral fore-end are "<" shaped male parts. Especially, Element 17 is the male part to prevent the fore-end of the bristle part from shaking laterally. Element 19 is rooted bristles. This is a lateral view of male parts 15, 16, 17 with the shaking prevention "<" shape on the bristle part 11.

Figure 28:
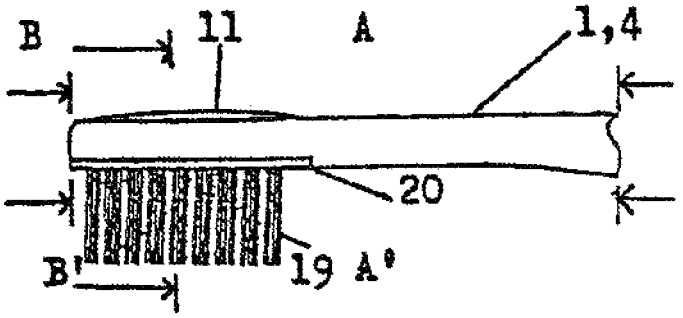
FIG. 28 is a lateral view of a toothbrush with FIG. 27 being installed in FIG. 25.

In FIG. 28, Element 1 is a toothbrush, and Element 4 is a toothbrush body. This is lateral view of the fore-end of the toothbrush 1 which represents both bristle part 11 of FIG. 27 and head 7 at the fore-end of the toothbrush body 4 for bristle part 11. Element 19 is bristles. Element 20 is the stopper as described above.

Figure 29:
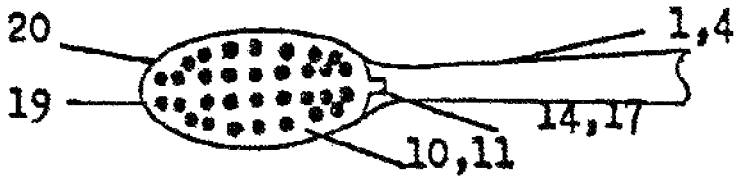
FIG. 29 is a basal view of FIG. 28.

FIG. 29 is a basal view of FIG. 28. Element 10 is a board, Element 1 is a toothbrush, and Element 4 is a toothbrush body. Element 20 is the aforementioned stopper, Element 19 is rooted brushes, and Element 14 represents female part 14 in board and male part 17 in toothbrush body 4 as a shaking prevention device when bristle part 11 is attached to toothbrush body 4.

Figure 30:
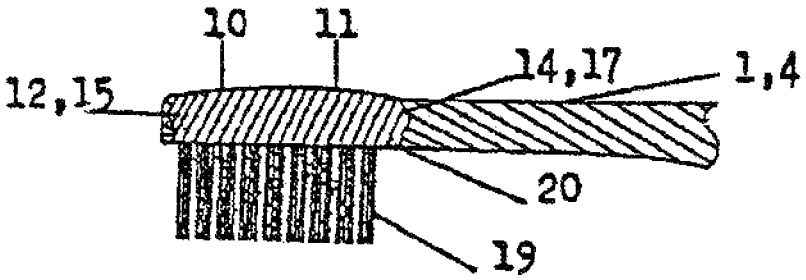
FIG. 30 is a A-A' line cross-sectional view of FIG. 28.

FIG. 30 is a A-A' line cross-sectional view of FIG. 28. Element 1 is a toothbrush, and Element 4 is a toothbrush body. Element 10 is a board, Element 11 is a bristle part, Element 19 is bristles and Element 20 is a stopper. Elements 12, 14 are female parts which have "<" shaped inside 21, 22 of the toothbrush body 4. Element 14, 17 are male parts which have "<" shaped lateral surfaces 23, 24 to bristle part 11.

This implementation example is the toothbrush 1 as described above, the bottom of the bristle part 11 and the base of the toothbrush body 4 fit in the same plane, when the bristle part 11 is assembled to the head 7 of the toothbrush body 4.

As described below, a sixth embodiment of the invention is shown in FIGS. 31 to 36.

Figure 31:
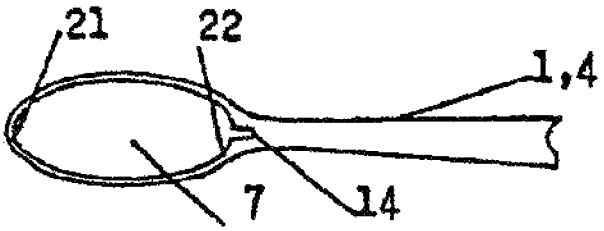
FIG. 31 is a plane figure of a toothbrush body fore-end.

FIG. 31 is a plane figure of toothbrush body 4 of toothbrush 1 which has installation head 7 at the fore-end part. Fore-end inner lateral surfaces 21, 22 of toothbrush body 4 are head 7 which is "<" shaped to admit the bristle part 11 in FIG. 3 which has "<" shaped both right and left lateral male parts 15, 16, 17. Both sides of head 7 and the bristle part 11 have female and male parts 14, 17 to prevent the fore-end of the toothbrush from shaking during brushing with the toothbrush 1.

Figure 32:
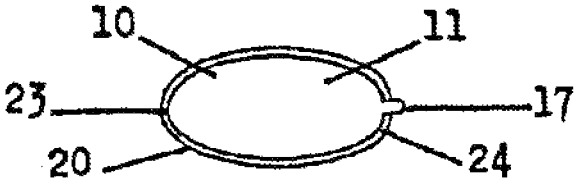
FIG. 32 is a plane figure of a bristle part.

FIG. 32 is a plane figure of bristle part 11 with board 10 which is attached to the head 7. Element 23, 24 are both left and right lateral surfaces. Element 17 is male part of bristle part 11 for preventing shaking when attached to female part 14 of FIG. 1.

Element 20 is the stopper for preventing dropping when assembled to the head 7.

Figure 33:
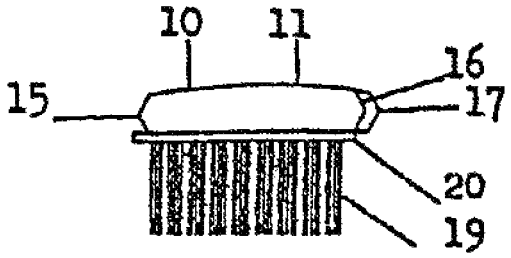
FIG. 33 is a lateral view of a bristle part.

In FIG. 33, Element 20 is the stopper for preventing dropping when the bristle part 11 is attached to the head 7 around the bottom of the board 10. Elements 15, 16, 17 of both lateral fore-ends are "<" shaped male parts. Especially, Element 17 is the male part to prevent the fore-end of the bristle part from shaking laterally. Element 19 is rooted bristles. This is a lateral view of male parts 15, 16, 17 with the shaking prevention "<" shape on the bristle part 11.

Figure 34:
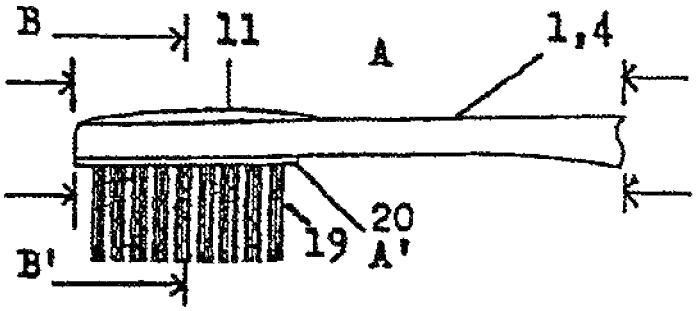
FIG. 34 is a lateral view of a toothbrush with FIG. 33 being installed in FIG. 31.

In FIG. 34, Element 1 is a toothbrush, and Element 4 is a toothbrush body. This is lateral view of fore-end of the toothbrush 1 which represents both bristle part 11 of FIG. 33 and head 7 at the fore-end of the toothbrush body 4 for bristle part 11. Element 19 is bristles. Element 20 is the stopper as described above.

Figure 35:
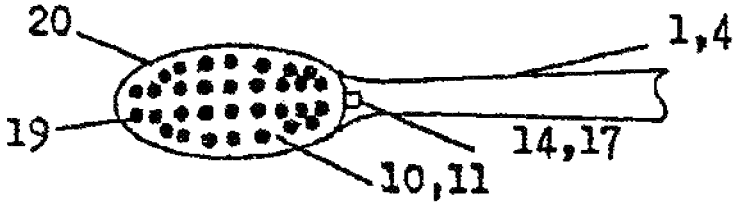
FIG. 35 is a basal view of FIG. 34.

FIG. 35 is a basal view of FIG. 34. Element 10 is a board, Element 1 is a toothbrush, and Element 4 is a toothbrush body. Element 20 is the aforementioned stopper, Element 19 is rooted brushes, and Element 14 represents female part 14 in board and male part 17 in toothbrush body 4 as a shaking prevention device when bristle part 11 is attached to toothbrush body 4.

Figure 36:
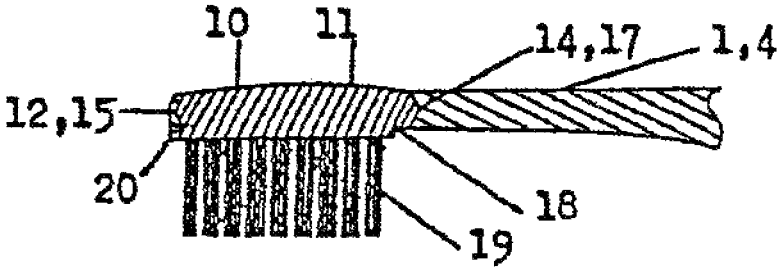
FIG. 36 is a A-A' line cross-sectional view of FIG. 34.

FIG. 36 is a A-A' line cross-sectional view of FIG. 34. Element 1 is a toothbrush, and Element 4 is a toothbrush body. Element 10 is a board, Element 11 is a bristle part, Element 19 is bristles and Element 20 is a stopper. Elements 12, 14 are female parts which have "<" shaped inside 21, 22 of the toothbrush body 4. Element 14, 17 are male parts which have "<" shaped lateral surfaces 23, 24 to bristle part 11.

This implementation example is the toothbrush 1 as described above, formed to be in the same level between the male part 14, 17 of the bristle part 11 and the base of the toothbrush body 4, when the bristle part 11 is attached to the head 7 of the toothbrush body 4.

As described below, a seventh embodiment of the invention is shown in FIGS. 37 to 52.

Figure 37:
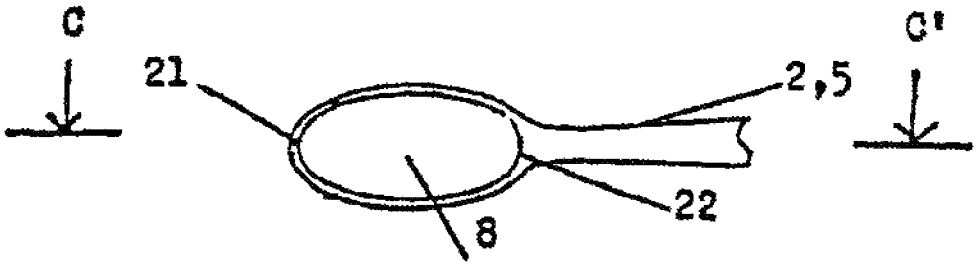
FIG. 37 is a plane figure of a toothbrush body fore-end.

FIG. 37 is a flat plane figure of the toothbrush body 5 with the head 7 at the fore-end of the toothbrush 2. Both right and left lateral male parts 15, 16, 17 at the inner lateral surfaces 21, 22 of the fore-end of the toothbrush body 5 are convex.

Figure 38:
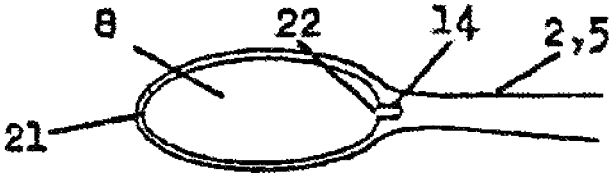
FIG. 38 is a basal view of FIG. 37.

FIG. 38 is a basal view of FIG. 37. FIG. 31 is a plane figure of toothbrush body 5 of toothbrush 2 which has installation head 7 at the fore-end part. Fore-end inner lateral surfaces 21, 22 of toothbrush body 4 are the head 7 which has curved male parts 15, 16, 17 at both right and left lateral surfaces. Both sides of head 7 and the bristle part 11 have female and male parts 14, 17 to prevent the fore-end of the toothbrush from shaking during brushing with the toothbrush 1.

Figure 39:
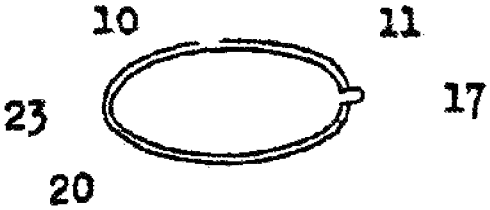
FIG. 39 is a plane figure of a bristle part.

FIG. 39 is a plane figure of bristle part 11 in FIG. 3. Elements 23, 24 are both left and right lateral surfaces. Element 17 is a male part of bristle part 11 for preventing shaking when attached to female part 14 of FIG. 1.

Element 20 is the stopper for preventing dropping when attached to the head 7.

Figure 40:
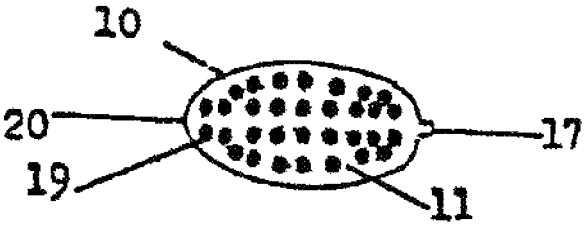
FIG. 40 is a basal view of FIG. 39.

FIG. 40 is a basal view of FIG. 39. Element 10 is a board, Element 11 is a bristle part. Element 20 is a detach preventing stopper when attached to the head 8 in FIG. 37. Element 19 is rooted bristles. Element 17 is male part 17 to prevent the fore-end of the toothbrush 2 from shaking laterally, when the bristle part is attached to the head 8 from the basal view direction of FIG. 38.

Figure 41:
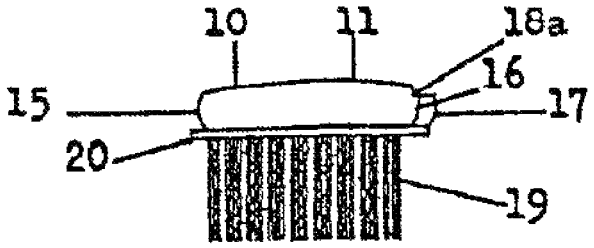
FIG. 41 is a lateral view of a bristle part.

FIG. 41 is a lateral view of bristle part 11 which is attached to the head 8 of FIG. 37. The bristle part has a detach preventing stopper 20 at the base of the board 10, curved male parts 15, 16, 17 at both lateral surfaces of enrooted bristle part 11, and the step 18*a* at the upper portion of male part 16 not to protrude from the upper portion of toothbrush body 5.

Figure 42:
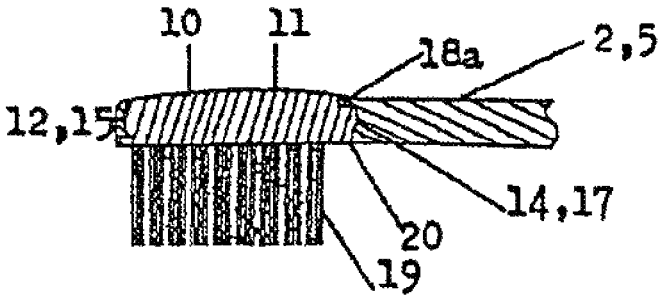
FIG. 42 is a C-C' line cross-sectional view with the bristle part of FIG. 41 being attached in FIG. 37.

FIG. 42 is a C-C' line cross-sectional view with FIG. 41 assembled to FIG. 37. Element 10 is a board, and Element 11 is a bristle part. The bristle part is attached to head 8 for bristle part 11 which is at the fore-end of toothbrush body 5 of toothbrush 2. Elements 12, 14 are female parts, Element 15, 17 are male parts, and Element 19 is bristles. The assembled stopper 20 base in the bristle part makes the same plane with the base of toothbrush.

Figure 43:
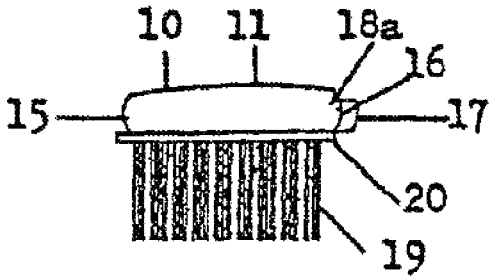
FIG. 43 is a lateral view of a bristle part.

FIG. 43 is a lateral view of bristle part 11 which is attached to the head 8 of FIG. 37. The bristle part has a detach preventing stopper 20 at the base of the board 10, curved male parts 15, 16, 17 at both lateral surfaces of enrooted bristle part 11, and the step 18*a* at the upper portion of male part 16 not to protrude from the upper portion of toothbrush body 5.

Figure 44:
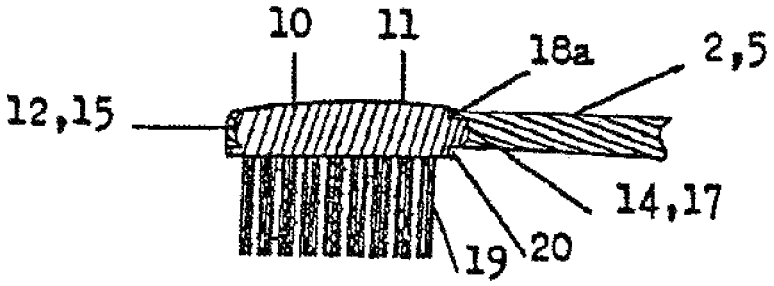
FIG. 44 is a C-C' line cross-sectional view with the bristle part of FIG. 43 being attached in FIG. 37.

FIG. 44 is a C-C' line cross-sectional view with FIG. 41 assembled to FIG. 37. Element 10 is a board, and Element 11 is a bristle part. The bristle part is attached to head 8 for bristle part 11 which is at the fore-end of toothbrush body 5 of toothbrush 2. Elements 12, 14 are female parts, Elements 15, 17 are male parts, and Element 19 is bristles. The assembled stopper 20 base in bristle part 11 is designed to protrude from the base of the toothbrush body 5.

Figure 45:
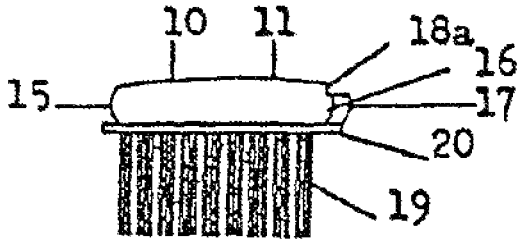
FIG. 45 is a lateral view of a bristle part.

FIG. 45 is a lateral view of bristle part 11 which is attached to the head 8 of FIG. 37. The bristle part has a detach preventing stopper 20 at the base of the board 10, curved male parts 15, 16, 17 at both lateral surfaces of enrooted bristle part 11, and the step 18*a* at the upper portion of male part 16 not to protrude from the upper portion of toothbrush body 5.

Figure 46:
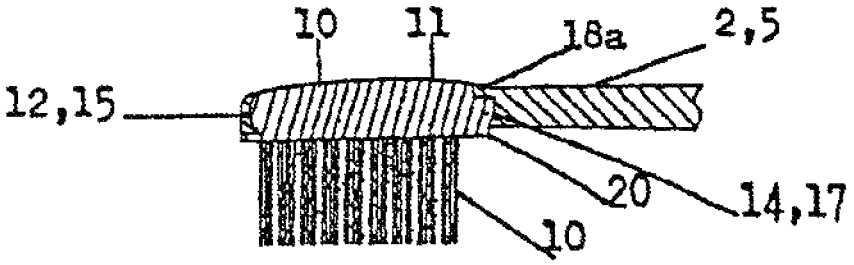
FIG. 46 is a C-C' line cross-sectional view with the bristle part of FIG. 45 being attached in FIG. 37.

FIG. 46 is a C-C' line cross-sectional view with the FIG. 45 attached to FIG. 37. Element 10 is a board, and Element 11 is a bristle part. The bristle part is attached to head 8 for bristle part 11 which is at the fore-end of toothbrush body 5 of toothbrush 2. Elements 12, 14 are female parts, Elements 15, 17 are male parts, and Element 19 is bristles. The assembled stopper 20 base in bristle part is designed to protrude from the base of the toothbrush body 5.

The shapes of the lateral surfaces of the head 8 and bristle part 11 from FIG. 37 to FIG. 46 are curved.

Figure 47:
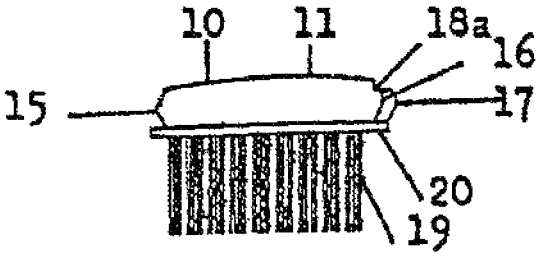
FIG. 47 is a lateral view of bristle part.

FIG. 47 is a lateral view of the bristle part 11 which is attached to the head 8 of the FIG. 37. The bristle part has a detach preventing stopper 20 at the base of the board 10, "<" shaped male parts 15, 16, 17 at both lateral surfaces of enrooted bristle part 11, and the step 18*a* at the upper portion of male part 16 not to protrude from the upper portion of toothbrush body 5.

Figure 48:
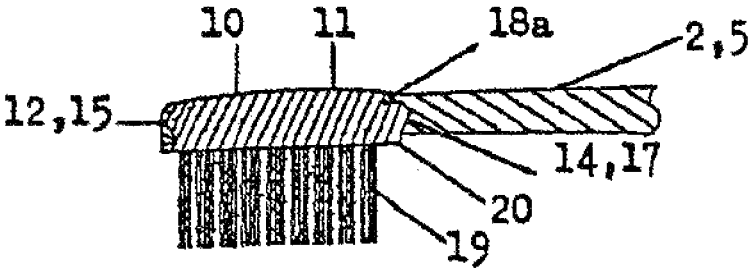
FIG. 48 is a C-C' line cross-sectional view with the bristle part of FIG. 47 being attached in FIG. 37.

FIG. 48 is a C-C' line cross-sectional view with FIG. 47 attached to FIG. 37. Element 10 is a board, and Element 11 is a bristle part. The bristle part is attached to head 8 for bristle part 11 which is at the fore-end of toothbrush body 5 of toothbrush 2. Elements 12, 14 are female parts, and Elements 15, 17 are male parts. And they all are "<" shape. Element 19 is rooted bristles. The assembled stopper 20 base in bristle part 11 protrudes from the base of the toothbrush body 5.

Figure 49:
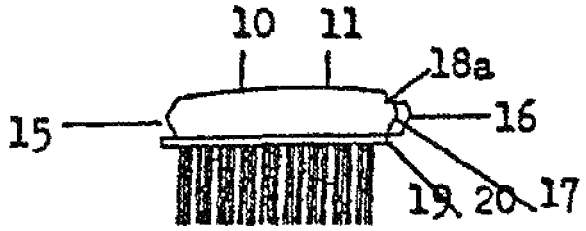
FIG. 49 is a lateral view of bristle part.

FIG. 49 is a lateral view of the bristle part 11 which is attached to the head 8 of the FIG. 37. The bristle part has a detach preventing stopper 20 at the base of the board 10, "<" shaped male parts 15, 16, 17 at both lateral surfaces of enrooted bristle part 11, and the 18*a* at the upper portion of male part 16 not to protrude from the upper portion of toothbrush body 5.

Figure 50:
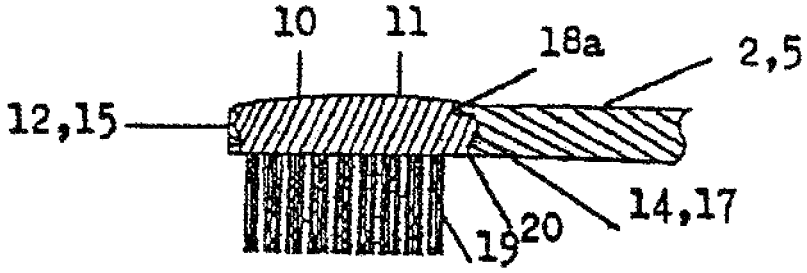
FIG. 50 is a C-C' line cross-sectional view with the bristle part of FIG. 49 being attached in FIG. 37.

FIG. 50 is a C-C' line cross-sectional view with FIG. 47 assembled to FIG. 37. Element 10 is a board, and Element 11 is a bristle part. The bristle part is attached to head 8 for bristle part 11 which is at the fore-end of toothbrush body 5 of toothbrush 2. Elements 12, 14 are female parts, and Elements 15, 17 are male parts. And they all are "<" shape. Element 19 is rooted bristles. The assembled stopper 20 base in bristle part 11 protrudes from the base of the toothbrush body 5.

Figure 51:
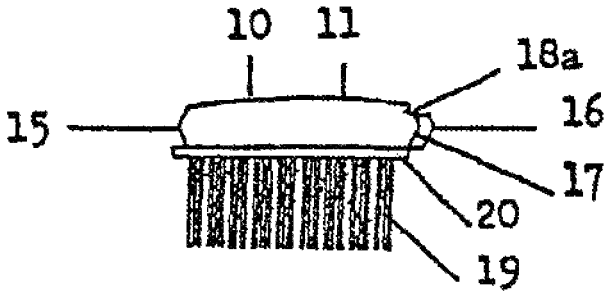
FIG. 51 is a lateral view of bristle part.

FIG. 51 is a lateral view of the bristle part 11 which is attached to the head 8 of the FIG. 37. The bristle part has a detach preventing stopper 20 at the base of the board 10, "<" shaped male parts 15, 16, 17 at both lateral surfaces of enrooted bristle part 11, and the step 18*a* at the upper portion of male part 16 not to protrude from the upper portion of toothbrush body 5.

Figure 52:
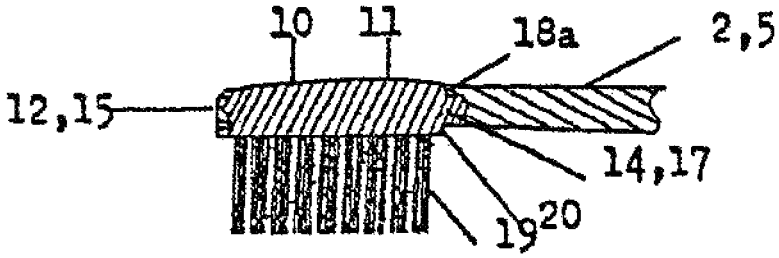
FIG. 52 is a C-C' line cross-sectional view with the bristle part of FIG. 51 being attached in FIG. 37.

FIG. 52 is a C-C' line cross-sectional view with FIG. 51 assembled to FIG. 37. Element 10 is a board, and Element 11 is a bristle part. The bristle part is attached to head 8 for bristle part 11 which is at the fore-end of toothbrush body 5 of toothbrush 2. Elements 12, 14 are female parts, and Elements 15, 17 are male parts. And they all are "<" shape. Element 19 is bristle enrooted. The assembled stopper 20 base in bristle part 11 protrudes from the base of the toothbrush body 5.

The lateral surfaces of the head 8 and bristle part 11 from FIGS. 48 to 52 are "<" shaped.

As described below, an eighth embodiment of the invention is shown in FIGS. 53 to 68.

Figure 53:
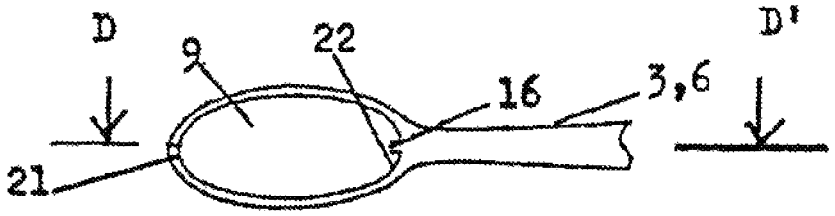
FIG. 53 is a plane figure of a toothbrush body fore-end.

FIG. 53 is a toothbrush 3, and Element 6 is a toothbrush body. It is the plane figure with the male part 16 at the head 9, for the bristle part, in the fore-end of the brush body 6. Elements 21, 22 are lateral surfaces of the head 9.

Figure 54:
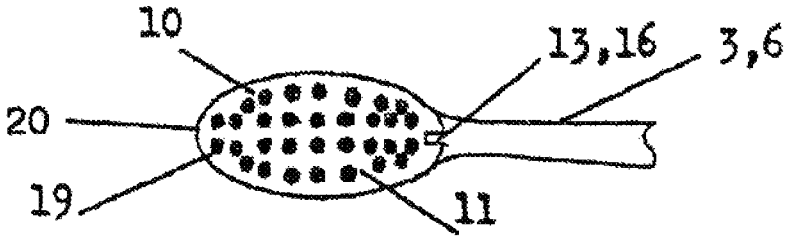
FIG. 54 is a basal view of FIG. 53 with the bristle part of FIG. 55 being attached.
Figure 57:
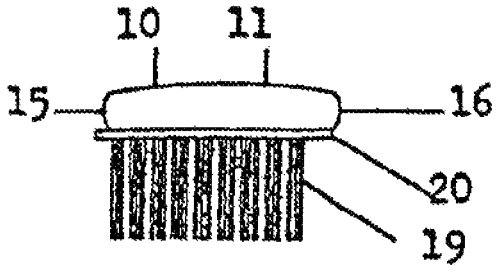
FIG. 57 is a lateral view of a bristle part.

FIG. 54 is a basal view of FIG. 53 with FIG. 57 attached. Element 10 is a board, Element 11 is a bristle part, Element 20 is a stopper, and Element 19 is rooted bristles. Elements 13 and 16 are female and male parts for preventing shaking of toothbrush 3.

Figure 55:
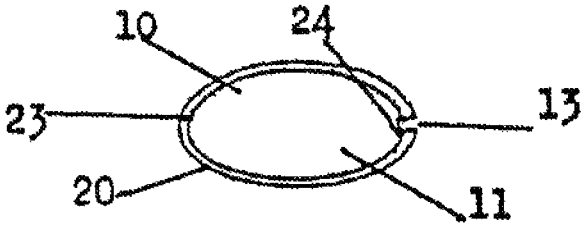
FIG. 55 is a plane figure of a bristle part.

FIG. 55 is a plane figure of bristle part 11. Elements 23, 24 are curved lateral surfaces, Element 10 is a board, Element 20 is a stopper and Element 13 is a female part.

Figure 56:
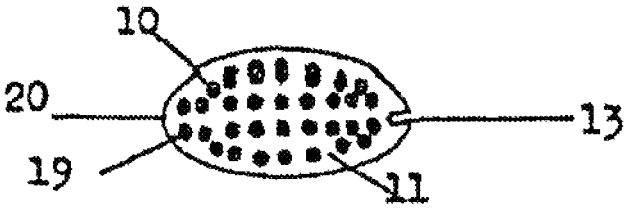
FIG. 56 is a basal view of bristle part of FIG. 55.

FIG. 56 is a basal view of FIG. 55. Element 13 is a shake-preventing female part, Element 10 is a board, Element 11 is a bristle part, Element 20 is a stopper, and Element 19 is rooted bristles.

FIG. 57 is a lateral view of bristle part 11 which is attached to the head 9 in FIG. 53. Element 10 is a board, Element 11 is a bristle part, Elements 15, 16, are curved male parts, and Element 20 is a detach preventing stopper. Element 19 is rooted bristles.

Figure 58:
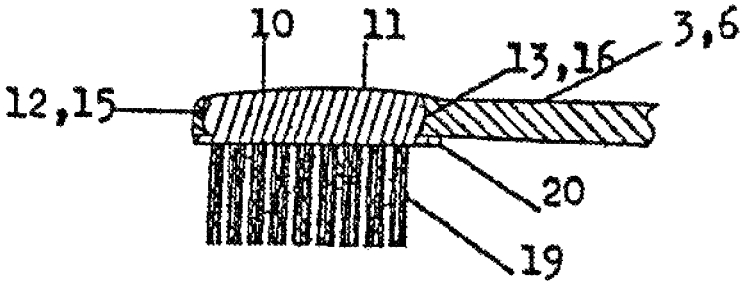
FIG. 58 is a D-D' line cross-sectional view with the bristle part of FIG. 57 being attached to FIG. 53's toothbrush body.

FIG. 58 is a D-D' line cross-sectional view with bristle part 11 of FIG. 57 attached to the head 9 of FIG. 53. Element 3 is a toothbrush, Element 6 is a toothbrush body, Element 10 is a board, Element 11 is a bristle part, Element 20 is a stopper, Element 19 is bristles, and Elements 12, 15 and 13, 16 are curved female and male parts.

Figure 59:
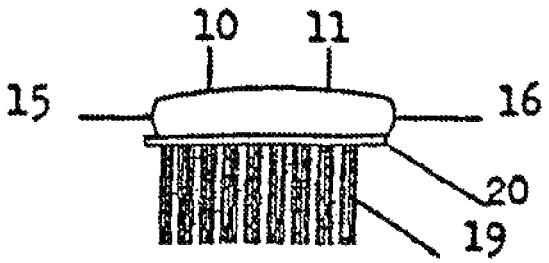
FIG. 59 is a lateral view of a bristle part.

FIG. 59 is a lateral view of bristle part 11 which is attached to the head 9 in FIG. 53. Element 10 is a board, Element 11 is a bristle part, Elements 15, 16, are curved male parts, and Element 20 is a detach preventing stopper. Element 19 is rooted bristles.

Figure 60:
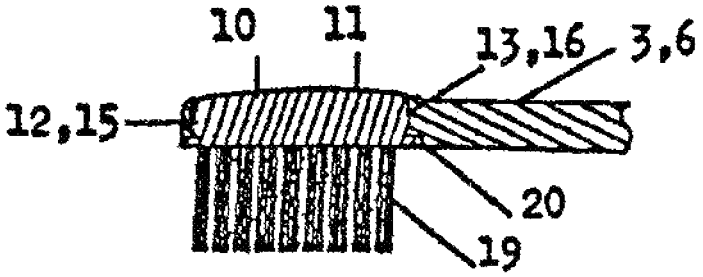
FIG. 60 is a D-D' line cross-sectional view with the bristle part of FIG. 59 being attached to FIG. 53's toothbrush body.

FIG. 60 is a D-D' line cross-sectional view with bristle part 11 of FIG. 59 attached to the head 9 of FIG. 53. Element 3 is a toothbrush, Element 6 is a toothbrush body, Element 10 is a board, Element 11 is a bristle part, Element 20 is a stopper, Element 19 is bristles, and Elements 12, 15 and 13, 16 are curved female and male parts.

Figure 61:
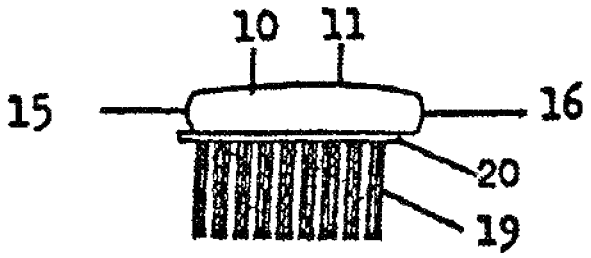
FIG. 61 is a later view of a bristle part.

FIG. 61 is a lateral view of bristle part 11 which is attached to the head 9 in FIG. 53. Element 10 is a board, Element 11 is a bristle part, Elements 15, 16, are curved male parts, and Element 20 is a detach preventing stopper. Element 19 is rooted bristles.

Figure 62:
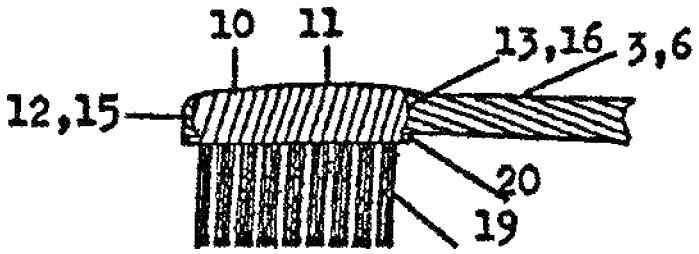
FIG. 62 is a D-D' line cross-sectional view with the bristle part of FIG. 61 being attached to FIG. 53's toothbrush body.

FIG. 62 is a D-D' line cross-sectional view with bristle part 11 of FIG. 61 attached to the head 9 of FIG. 53. Element 3 is a toothbrush, Element 6 is a toothbrush body, Element 10 is a board, Element 11 is a bristle part, Element 20 is a stopper, Element 19 is bristles, and Elements 12, 15 and 13, 16 are curved female and male parts.

Figure 63:
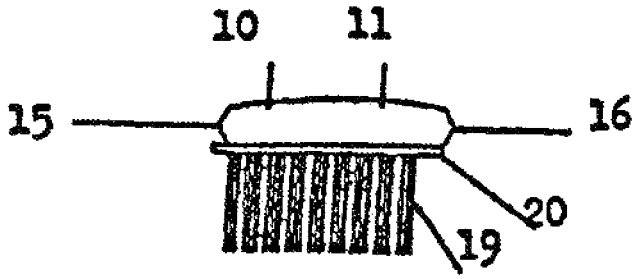
FIG. 63 is a lateral view of a bristle part.

FIG. 63 is a lateral view of bristle part 11 which is attached to the head 9 in FIG. 53. There is a detach preventing stopper 13 when attached to the head 9, and "<" shaped male parts 15, 16 on both lateral surfaces at the base of board 10. Element 19 is bristles.

Figure 64:
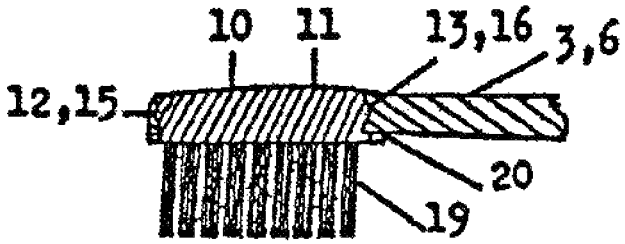
FIG. 64 is a D-D' line cross-sectional view with the bristle part of FIG. 63 being attached to the toothbrush body of FIG. 53.

FIG. 64 is a D-D' line cross-sectional view with bristle part 11 of FIG. 57 attached to the head 9 of the FIG. 53. Element 6 is a toothbrush body of toothbrush 3, Element 10 is a board, and Element 11 is a bristle part. The female parts 12, 13 of the inner lateral surfaces of toothbrush boy 6 are concave, and the male parts 15, 16 of the lateral surfaces of the fore-end of the bristle part 11 have the shape of a curve. Element 20 is a detach preventing stopper where the bristle part 11 is attached to the head 9 as described above. Element 19 is bristles.

Figure 65:
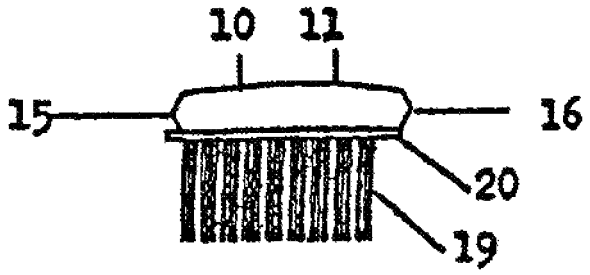
FIG. 65 is a lateral view of a bristle part.

FIG. 65 is a lateral view of bristle part 11 which is attached to the head 9 in FIG. 53. There is a detach preventing stopper 13 when attached to the head 9, and "<" shaped male parts 15, 16 on both lateral surfaces at the base of board 10. Element 19 is bristles.

Figure 66:
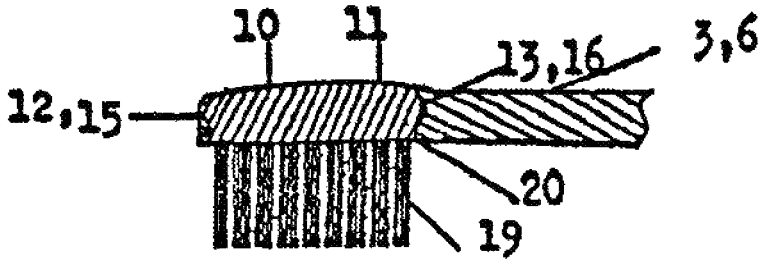
FIG. 66 is a D-D' line cross-sectional view with the bristle part of FIG. 65 being attached to the toothbrush body of FIG. 53.

FIG. 66 is a D-D' line cross-sectional view with bristle part 11 of FIG. 57 attached to the head 9 of the FIG. 53. Element 6 is a toothbrush body of toothbrush 3, Element 10 is a board, and Element 11 is a bristle part. The female parts 12, 13 of the inner lateral surfaces of toothbrush boy 6 are concave, and the male parts 15, 16 of the lateral surfaces of the fore-end of the bristle part 11 have the shape of a curve. Element 20 is a detach preventing stopper where the bristle part 11 is attached to the head 9 as described above. Element 19 is bristles.

Figure 67:
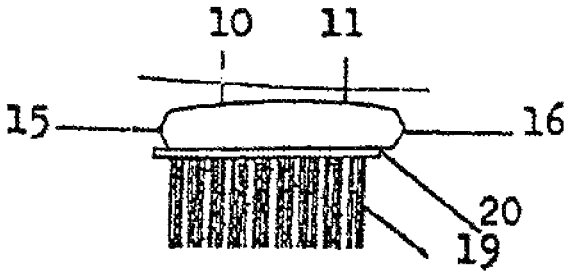
FIG. 67 is a lateral view of a bristle part.

FIG. 67 is a lateral view of bristle part 11 which is attached to the head 9 in FIG. 53. There is a detach preventing stopper 13 when attached to the head 9, and "<" shaped male parts 15, 16 on both lateral surfaces at the base of board 10. Element 19 is bristles.

Figure 68:
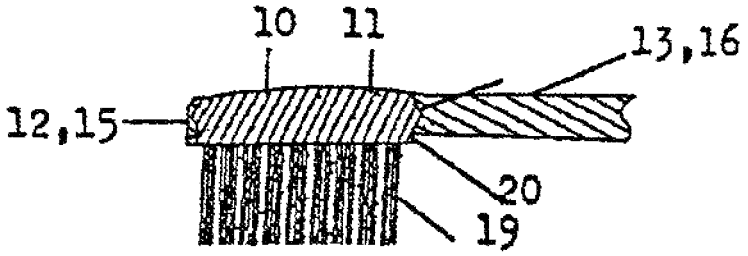
FIG. 68 is a D-D' line cross-sectional view with the bristle part of FIG. 67 being attached to the toothbrush body of FIG. 53.

FIG. 68 is a D-D' line cross-sectional view with bristle part 11 of FIG. 57 attached to the head 9 of the FIG. 53. Element 6 is a toothbrush body of toothbrush 3, Element 10 is a board, and Element 11 is a bristle part. The female parts 12, 13 of the inner lateral surfaces of toothbrush boy 6 are concave, and the male parts 15, 16 of the lateral surfaces of the fore-end of the bristle part 11 have the shape of a curve. Element 20 is a detach preventing stopper where the bristle part 11 is attached to the head 9 as described above. Element 19 is bristles.

In FIG. 53 to FIG. 62, inner surfaces of head 9 and fore-end lateral surfaces of bristle part 11 are curved, and in FIGS. 63 to 68, they are "<" shaped.

Figure 69:
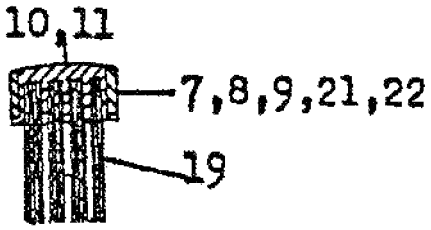
FIG. 69 is a B-B' line cross-sectional view of a bristle part.

FIG. 69 is a B-B' line cross-sectional view of FIGS. 4, 16, 22, and 36. Element 10 is a board, Element 11 is a bristle part, Elements 21, 22 are lateral surfaces of head, and Element 7, 8, 9 are installation heads.

Figure 70:
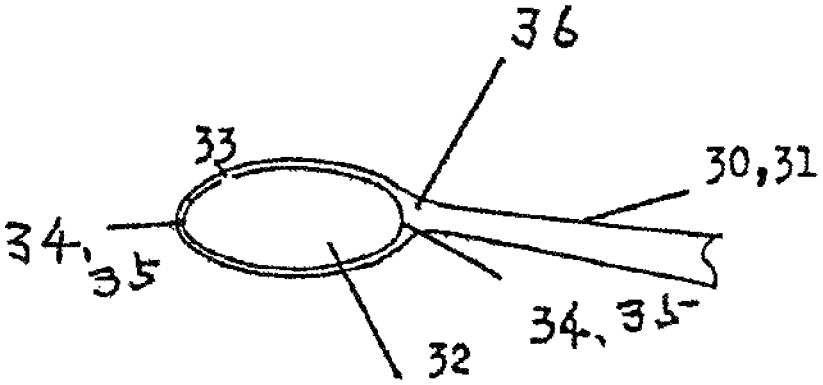
FIG. 70 is a reference drawing illustrating a fore-end of brush that is shaking to the left and right.

As both the inner lateral surfaces of the head 32 for the bristle part 33 prepared at the fore-end of the toothbrush body 31 of the conventional toothbrush 30 and the fore-end lateral surfaces of the bristle part 33 are curved or "<" shaped in FIG. 70, when the toothbrush 30 in FIG. 70 is used as described above, the fore-end head portion at the toothbrush body for bristle part 33 shakes laterally.

REFERENCE NUMERALS

1, 2, 3, 30: toothbrush
4, 5, 6, 31: toothbrush body
7, 8, 9, 32: head
10: board
11, 33: bristle part
12, 13, 14, 34: female part
15, 16, 17, 35: male part
18, 18*a*: step
19: bristles
20: stopper
21, 22, 23, 24: lateral surface
36: points
A-A', B-B': direction

What is claimed is:

1. A toothbrush comprising:

a toothbrush body having a head formed at a fore-end of the toothbrush body, the head being formed in an oval-ring shape, the inner lateral surface of the head being a first female part or male part of the head, the head having a second female part or male part being aligned along the longitudinal axis of the toothbrush body and disposed at substantially one end of the longitudinal axis of the head, the one end connecting to the fore-end of the toothbrush body; and an oval bristle part having bristles installed at a board thereof, the oval bristle part configured to be coupled to the head, the outer lateral surface of the oval bristle part being a first male or female part thereof, the oval bristle part having a second male or female part at substantially one end of the longitudinal axis thereof, and a stopper being formed around the circumference of the board with the bristles installed, protruding outwardly by a predetermined length, the first male or female part of the oval bristle part being releasably coupled to the first female or male part of the head by mutual elastic deformation, the second male or female part of the oval bristle part being releasably coupled to the second female or male part of the head, whereby, during tooth brushing, the coupling of the second male or female part of the oval bristle part to the second female or male part of the head prevents the fore-end of the toothbrush from shaking laterally and the stopper prevents the oval bristle part from detaching from the head.

* * * * *